US005462265A

United States Patent [19]

Mandel et al.

[11] Patent Number: 5,462,265

[45] Date of Patent: Oct. 31, 1995

[54] VARIABLE FORCE SHEETS OR SET EJECTOR

[75] Inventors: Barry P. Mandel, Fairport; Suzzette S. Resto, Victor; Charles D. Rizzolo, Rochester; Frederick A. Green, Fairport; Richard A. Van Dongen, Newark; Phillip A. Billings, Fairport, all of N.Y.

[73] Assignee: Xerox Corporation, Stamford, Conn.

[21] Appl. No.: 334,984

[22] Filed: Nov. 7, 1994

[51] Int. Cl.[6] ..... B42B 2/02; B65H 39/02; B65G 57/00

[52] U.S. Cl. ..... 270/53; 270/58; 414/789.9

[58] Field of Search ..... 270/53, 58; 271/274; 414/789.9, 790.2; 198/836.1, 836.3

[56] References Cited

U.S. PATENT DOCUMENTS

| | | | |
|---|---|---|---|
| 3,947,111 | 3/1976 | Hoppner | 271/274 X |
| 4,750,853 | 6/1988 | Van Soest et al. | 414/789.9 |
| 4,826,383 | 5/1989 | Millen | 414/789.9 |
| 4,946,152 | 8/1990 | Ishikawa et al. | 270/58 X |
| 5,021,837 | 6/1991 | Uto et al. | 270/53 X |
| 5,186,445 | 2/1993 | Nakanishi et al. | 270/53 |
| 5,201,503 | 4/1993 | Matsui et al. | 270/53 |
| 5,288,062 | 2/1994 | Rizzolo et al. | 270/53 |
| 5,308,058 | 5/1994 | Mandel et al. | 271/297 |
| 5,328,169 | 7/1994 | Mandel | 271/290 |
| 5,346,203 | 9/1994 | Stemmle | 270/58 X |
| 5,382,011 | 1/1995 | Tani | 270/53 X |
| 5,398,918 | 3/1995 | Rizzolo et al. | 270/53 |

*Primary Examiner*—John E. Ryznic

[57] ABSTRACT

In an output sheet handling system for a reproduction apparatus, for selective stacking of the output sheets into at least one stacking tray, with a sheet ejection system for gripping and ejection of the output of the printed sheets into a stacking tray sequentially as individual output sheets or as a compiled stack of sheets, the sheet ejection system includes an automatic variable normal force system automatically providing a substantially higher gripping normal force for ejection of a compiled stack of sheets than for ejection of individual output sheets. The ejection system preferably increases the gripping normal force for the set ejection in proportion to the thickness of the compiled stack being ejected, and feeds individual delicate sheets through a nip with an automatically substantially lower normal force.

9 Claims, 8 Drawing Sheets

VARIABLE FORCE SHEETS OR SET EJECTOR

There is disclosed in the embodiments herein an improved, low cost and simple system for ejecting varying numbers of printed sheets of various weights without requiring a high power, high torque drive, and yet also providing for the protection of delicate sheets such as carbonless pressure-sensitive paper or other special paper stocks easily marked or wrinkled.

By way of background, on-line set compiling and finishing is very desirable, particularly for the job sets printed precollated by many modern high volume printers, copiers and other reproduction apparatus. Precollated copy sets output can be provided by an electronic printer with automatic page reordering, or a recirculating document handler, both well known per se. A single or plural tray compiler may be used to stack and align sheets therein, one at a time, and, if desired, also stapling or otherwise finishing each collated job or copy set. Single or partial tray compiler/staplers are disclosed, for example, in U.S. Pat. Nos. 5,098,074; 4,417,801; 4,541,626; 5,098,074; 5,120,047; 5,201,517; 5,288,062; 5,308,058; 5,289,251; and 5,328,169 (the latter, and U.S. Pat. No. 5,308,058, FIG. 2 compiler is like that of FIG. 2 herein). In the system examples illustrated hereinbelow, a compiler tray may be a part of, or have a sheet input path directly or indirectly from, a reproduction apparatus sequentially providing output sheets, to compile sets of those sheets, as is generally known.

It is also well known in this art, for better stacking registration, to sequentially deposit the outputted sheets for stacking onto an inclined surface. That allows different sizes of sheets to be stacked using the same paper path and the same tray system, using partially gravity assisted stacking against a simple inboard or outboard registration wall or surface. However, active stacking registration/alignment assistance systems, such as scuffers, flappers, tampers, joggers, etc., can be additionally provided for stacking and registration assistance. E.g., the illustrated "floppy belt" type reverse feeding top sheet jogger for initial uphill stacking thereover, with jogged registration at the downhill inboard end of the tray, as shown in U.S. Pat. Nos. 4,883,265; 5,098,074; 5,137,265; 5,288,062; 5,308,058; 5,328,169; etc.

It is known that compilers may be equipped to automatically eject each compiled sheet set into a downstream stacking tray or bin with a set ejector of some sort, such as the closable driven roll nips illustrated herein and in above-cited art. However, with downhill inboard registration, as is also illustrated in the compiler examples herein, the compiled set must be ejected uphill, partially against gravity, into its stacking tray or bin. That makes set ejection more difficult, especially for heavy or thick compiled sets. The present system is directed to improvements as to these and other problems.

Further by way of background, it is also known that various known lateral or side edge sheet registration systems, such as lateral joggers, tampers, and/or edge guides, may be compatibly provided in compiler systems. Some examples are in U.S. Pat. No. 5,044,625 (D/87242), art cited therein, and various other art cited herein. Accordingly, there is no need to illustrate examples here. It is also known that during the compiling operation, the compiler shelf or tray need only support part of the sheets, with part of the sheets being compiled partially extending into the stacking bin or tray, on top of the bin, tray, or prior sets stacked therein, as disclosed in U.S. Pat. Nos. 5,098,074; 5,137,265; 5,201,517, 5,328,169; and other art cited herein.

Another potential application of the present system is in or as part of a "mailboxing" system. That is, an output system capable of independently handling and separating different jobs for different users or addressees automatically and simply. Sets or jobs of plural physical sheets outputted by a printer are variously directed into particular "mailbox" bins or sets of bins. This allows plural users to share a printer yet have the different users outputs automatically placed into different "mailboxes" or bins. "Mailboxing" is further described for example in Xerox Corporation U.S. Pat. No. 5,308,058 issued May 3, 1994, or U.S. Pat. No. 5,328,169 issued Jul. 12, 1994; U.S. Pat. No. 5,098,074 issued Mar. 24, 1992 and EPO application No. 0 241 273 published Oct. 14, 1987, and other art cited therein.

Job set ejection into the final output bin or tray presents special difficulties. As disclosed in said U.S. Pat. Nos. 5,308,058 and 5,098,074, a desirable feature for mailboxing systems is to optionally collate and staple or otherwise bind, fasten or finish the sheets of each user job together, so that plural finished sets may be stacked in the users bins, maintained separated from other job sets therein by being so fastened. This can be done by pre-compiling and stapling each set before they are placed into mailbox bins, such as with a moving compiler/stapler unit repositionable adjacent the user bin to be loaded, as described in the above-cited patents, and shown in FIG. 2 here. In-bin stapling in the output bins themselves is an alternative.

Further by way of background, as is also shown in the art, the stacking tray or bin into which job sets are ejected from a compiler may be an elevator type, in which the tray moving down as it fills to maintain the top of the stack slightly below the compiler exit level. Conventional elevator-moved stacking trays can be used, like those described in the above-cited U.S. Pat. Nos. 5,098,074 or 5,137,265; 5,026,034; 4,541,763; or 4,880,350. Alternatively, especially in a mailboxing system, compiler/stapler units can move or reposition as an output stacking tray fills. This desirably allows a simple fixed tray to be used, with no elevator mechanism for that tray, by using the same indexing elevator system as is used to direct jobs from the compiler unit to selected mailbox bins.

The presently disclosed apparatus may be readily operated and controlled with conventional control systems. It is well known in general and preferable to program and execute such control functions and logic with conventional software instructions for conventional microprocessors. This is taught by various patents such as those cited above or U.S. Pat. No. 4,475,156 and art cited therein, and various commercial facsimile machines, copiers and sorters. Such software may of course vary considerably depending on the particular function and the particular software and the particular microprocessor being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hard-wired logic or switching systems.

A specific feature of the specific embodiments disclosed herein is to provide in an output sheet handling system for a reproduction apparatus, for selective stacking of the output sheets into at least one stacking tray, with a sheet ejection system for gripping and ejection of the output of the printed sheets from said reproduction apparatus into said stacking tray sequentially as individual output sheets or as a compiled stack of plural output sheets, the improvement wherein said sheet ejection system includes an automatic variable normal force system automatically providing a substantially higher gripping normal force for said ejection of said compiled stack of plural output sheets than for said ejection of said individual output sheets.

Further specific features provided by the system disclosed herein, individually or in combination, include those wherein said output sheet handling system includes a compiled sheets set stapling system, and wherein said sheet ejection system provides ejection of the output of printed sheets as a compiled and stapled stack of plural said output sheets from said reproduction apparatus, ejected by said sheet ejection system into said stacking tray as a stapled set of plural output sheets; and/or wherein said sheet ejection system increases said gripping normal force for said ejection in proportion to the thickness of said compiled stack of plural output sheets being ejected; and/or wherein said sheet ejection system comprises a closable sheet feeding nip providing said gripping normal force and said ejection and with at least two different operating modes; a first closed nip mode for said ejection of the output of printed sheets into said stacking tray as a previously compiled stack of plural said output sheets through said nip with said substantially higher gripping normal force in said nip, and a second closed nip mode for feeding individual delicate sheets through said nip with an automatically substantially lower said gripping normal force in said nip than in said first mode; and/or wherein said output sheet handling system includes a compiled sheets set stapling system, and wherein in said first mode said sheet ejection system provides ejection of the output of printed sheets as a compiled and stapled stack of plural said output sheets from said reproduction apparatus, ejected by said sheet ejection system into said stacking tray as a stapled set of plural output sheets; and/or in which said gripping normal force of said nip has a maximum force limit set to protect an object improperly inserted therein; and/or further including a third operating mode of said sheet ejection system in which said closable sheet feeding nip is open, with no sheet gripping normal force, to provide unobstructed sheet compiling prior to said sheet stack ejection with the sheets being compiled partially extending through said open nip; and/or further including a fourth operating mode of said sheet ejection system in which said closable sheet feeding nip is opened automatically in response to a sheet jam signal for sheet jam clearance; and/or wherein said sheet ejection system includes a nip opening and closing drive system for said closable sheet feeding nip, and an associated spring force system actuated to provide said substantially higher gripping normal force in said nip in said first mode in response to said drive system continuing to operate after closing said sheet feeding nip.

In the description herein the term "sheet" refers to a usually flimsy sheet of paper, plastic, or other such conventional individual image substrate. The "copy sheet" may be abbreviated as the "copy". A "job" is a set of related sheets, usually a collated copy set copied from a set of original document sheets or electronic page images from a particular user or otherwise related.

As to specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the examples below, as well as the claims. Thus, the present invention will be better understood from this description of these embodiments thereof, including the drawing figures (approximately to scale) wherein:

Figure 3A:
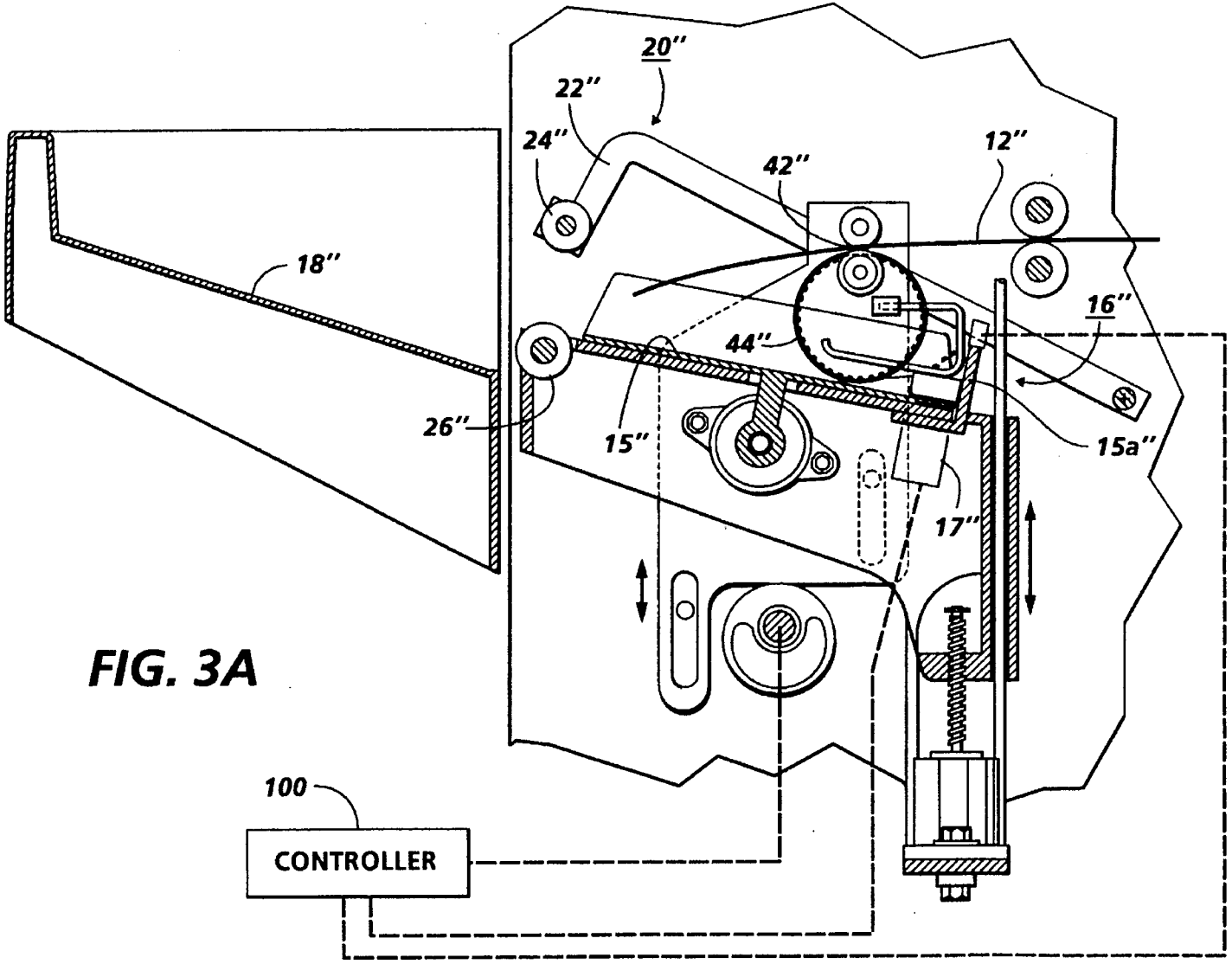
Figure 3B:
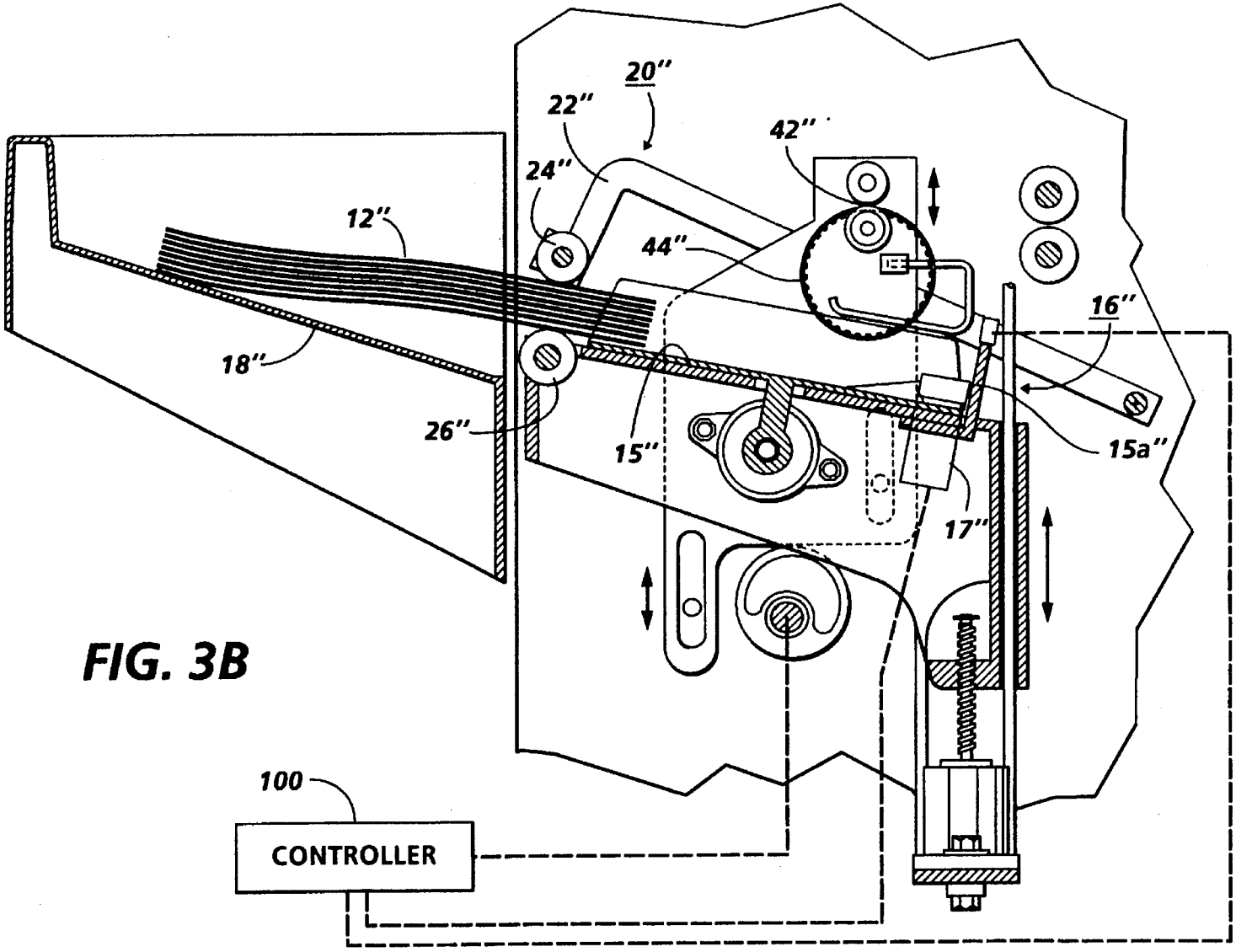
Figure 4:
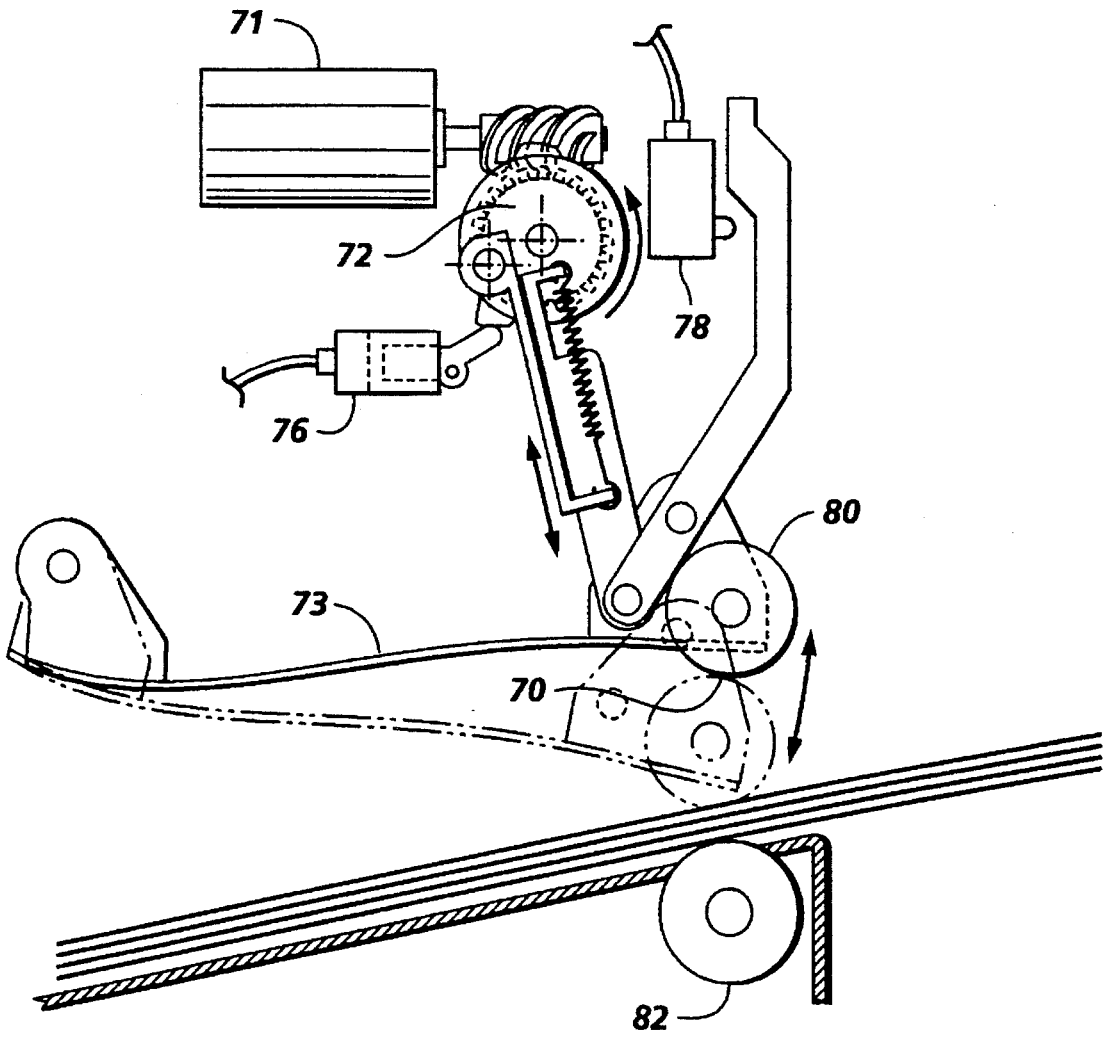

FIG. 3 (3A and 3B) is a side view of another finisher system which may incorporate the subject system, utilizing an eject arm with a different pivot point (the driving mechanism is not shown). The arm is shown in two different positions, with a single or first sheet entering in 3A and a compiled set being ejected in FIG. 3B; and FIG. 4 is an alternative embodiment, controlled with a single sensor and interlock switch, and a different mechanical actuation system.

Describing now in further detail the exemplary embodiment with reference to the Figures, the examples here of an output sheet compiling and/or stapling and ejecting system for a reproduction apparatus may be, for example, similar to but an improvement over, that disclosed and described in the above-cited Xerox Corporation patents such as U.S. Pat. No. 5,288,062 issued Feb. 22, 1994 (re FIG. 3) or U.S. Pat. No. 5,308,058 (re FIG. 2). Accordingly, common elements need not be re-described in detail herein. For clarity, common reference numbers, except that they are primed, are used in said different embodiments illustrated herein. A selectable sheet deflecting or bin gating input system 40 is also shown in the FIG. 2 embodiment. The sequentially incoming output sheets 12 from almost any reproduction apparatus may pass through almost any desired input feeder or gating system to the compiler, and thus need not be illustrated. All the incoming sheets 12 in the embodiments herein are first fed via an input feeding rollers nip 42 into a compiler unit 16. The compiler unit 16 here includes a partial compiler tray 15 and an integral stapling system 17.

Figure 2:
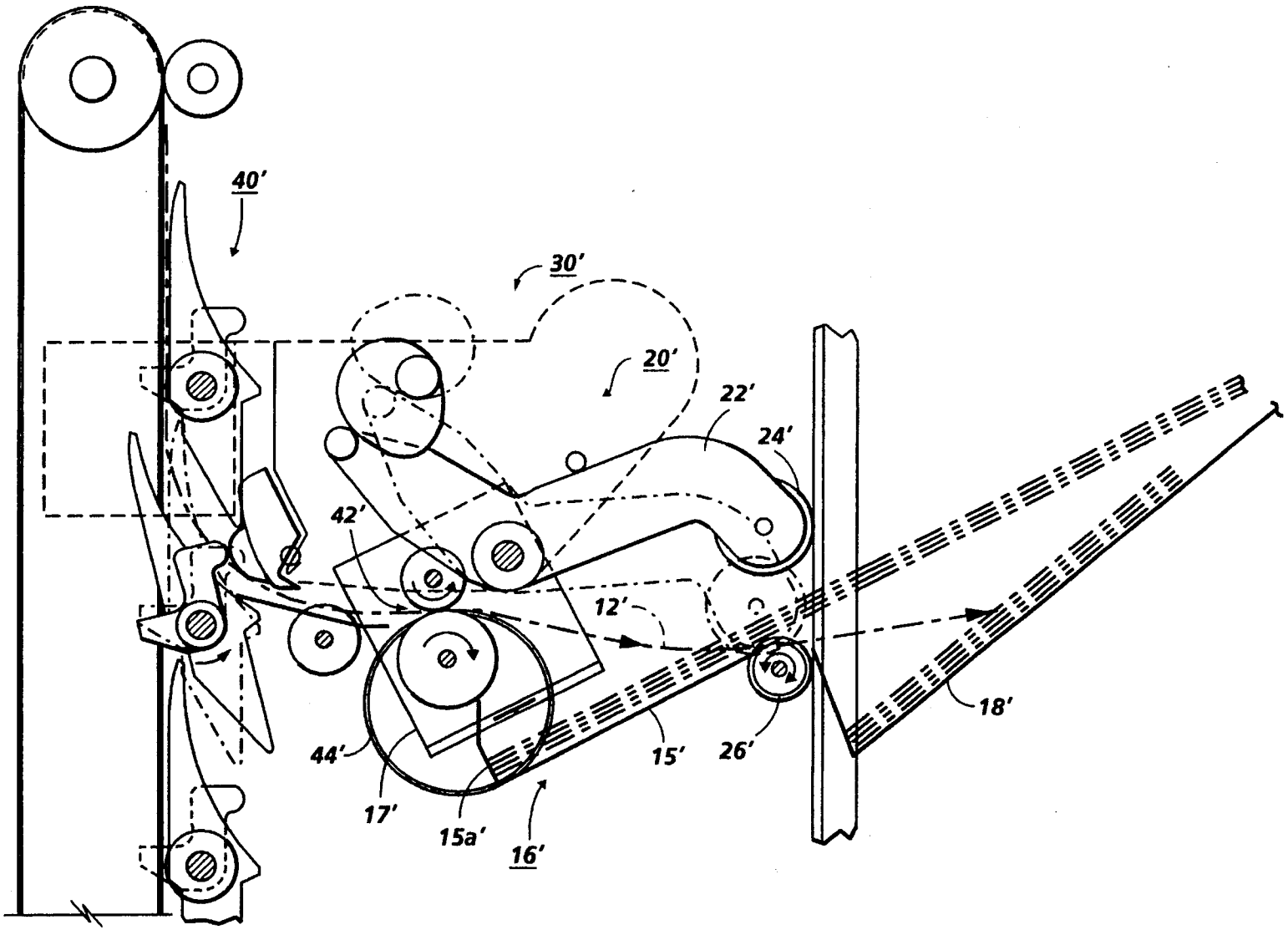
FIG. 2 is a side view of a previous design that did not, but can also be modified to, include the disclosed invention.

However, in a bypass or sorting mode individual sheets may be fed directly through the compiler/stapler unit 16 directly on into the adjacent output stacking bin or tray 18, without compiling in tray 15 or stapling, as shown for example in the darker dashed line path with arrows in FIG. 2. In this mode, a sheet ejection system 20 has its arm unit 22 moved down so that the upper ejection nip rollers 24 on the end of this arm 22 are held down in engagement with lower ejection nip rollers 26, to feed out the individual sheet into stacking tray 18.

Alternatively, the incoming sheets 12 may be compiled as a compiled set stack 14 in compiler tray 15, before being ejected from the compiler unit 16 as a plural sheet compiled set to be stacked in the output stacking bin or tray 18 on top of other plural sheet compiled sets. This may be done by dropping each incoming sheet 12 and feeding it backwards to register against the downhill stacking rear registration wall 15*a* or fingers of the compiling tray 15, on top of prior such stacked sheets. Once the incoming sheet has been discharged from the sheet entrance rolls nip 42 and drops onto partial compiler tray 15, it slides back downhill, and its upper surface is also contacted by a rotatable frictional flexible compiler jogger belt 44, causing the sheet to be driven back and downhill until it is fully registered against the upstanding rear wall 15*a* of the tray 15. This type of compressible open or "floppy belt" 44 jogger or compiler assistance is further disclosed in the above-cited U.S. Pat. Nos. 4,883,265 and 5,137,265, etc.. Each subsequent job sheet is compiled on top of the prior sheets on tray 15 in this manner, until one complete job set is compiled (a collated document copy set, faximile document, or whatever).

During this set compiling and registration mode, the set discharge system 20 has its arm unit 22 moved up, so that the nip is held open between the upper rollers 24 and the lower rollers 26, i.e., in an up position out of contact. That is, during this compiling cycle, the sheet ejection system 20 is not attempting to eject any of the sheets in the compiling tray 15, and the open nip allows the compiling set to stack therethrough, extending out partially through the open nip into the stacking tray 18. That is, during this compiling operation the sheets partially extended and hang out into the adjacent bin 18, saving overall dimensional space. That is, this particular illustrated compiler tray 15 is only a partial sheet supporting shelf for most sizes of sheets, as in the above-cited U.S. Pat. Nos. 5,098,074, 5,137,265, etc.

A conventional lateral registration tamper or jogger may also be provided in this compile mode, as in the cited art thereon. That is, once, or while, each incoming sheet is rear registered by the rotation of the floppy registration belts 44 thereagainst, a lateral tamper or jogger mechanism may engage each sheet to shift each sheet towards a lateral registration edge as is shown in the tray 15. Because the floppy registration belts 44 are so flexible, they are easily deformed in the lateral direction and do not resist such sideways movement of the sheet.

In the compile mode, once the reproduction apparatus controller 100 or other signal source indicates the end or last sheet being compiled of that job set, if a stapling signal is also provided, then the compiled set may be stapled in one or more positions by the stapling system 17 before the set is ejected.

Once the stapled (or unstapled) compiled set is fully compiled, it may be ejected, to feed out the set fully into stacking tray 18. The set ejection or discharge system 20 arm unit 22 moves down to close the nip on the set with an appropriate nip or normal force so that the set is fed out between the upper rollers 24 and the lower rollers 26. Note that this is feeding the set uphill, against gravity. In this mode, the set to be fed out is often much heavier than a single sheet, and with a different nip spacing depending on the set thickness.

As illustrated in the successive positional views of FIG. 1 A–D, there are three basic modes of operation of the illustrated plural mode sheet or set ejection system. As in FIG. 1A, an open nip 24, 26 mode of the sheet ejection unit 20 may be provided in which the arm unit 22 is raised. In this mode, sheet stacking is provided unobstructedly into the compiler. This is because this particular illustrated embodiment has a short compiler tray and part of the sheets stacking in the compiler extend into the associated output stacking tray adjacent thereto, as described in the cited references thereon.

In another two modes of operation, there is provided a closed ejection nip 24, 26. This nip is closed in the FIG. 1 embodiment by a variable force system 30 including a nip opening and closing drive system 31 driven by motor M1 here through a drive linkage 32 via a camming lever 33 and a cam engagement surface 34. In the initial closed nip mode of FIG. 1B, a very light nip normal force may be provided for appropriately feeding individual delicate sheets, such as carbonless transfer paper which is pressure sensitive, through the nip 24, 26 directly to the stacking tray 18 without compiling, i.e., bypassing the compiler tray 15.

Figure 1A:
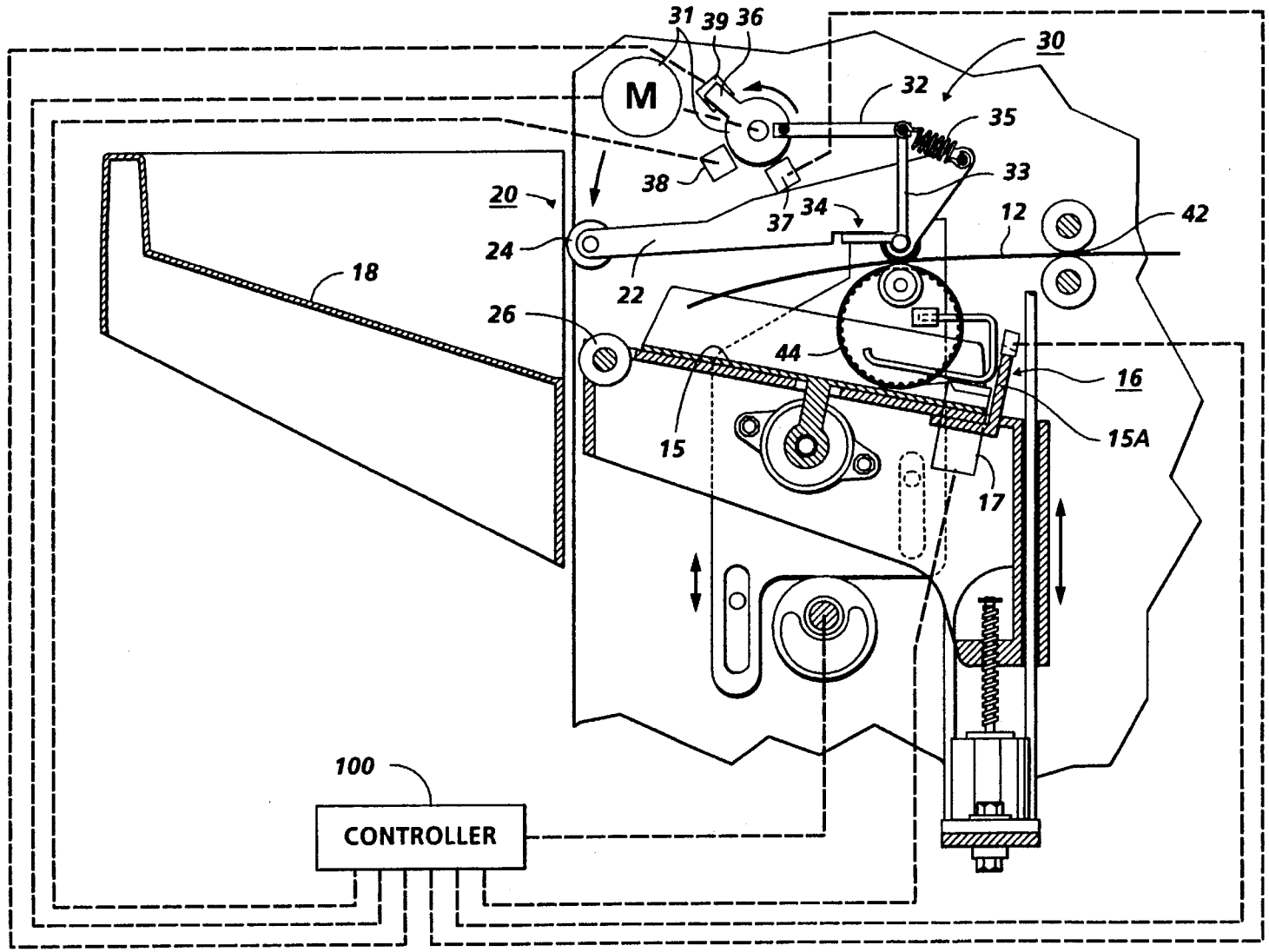
FIG. 1 (A–D) is a schematic side view of one exemplary embodiment of the disclosed variable force compiler ejection system shown in four different operating positions.
Figure 1B:
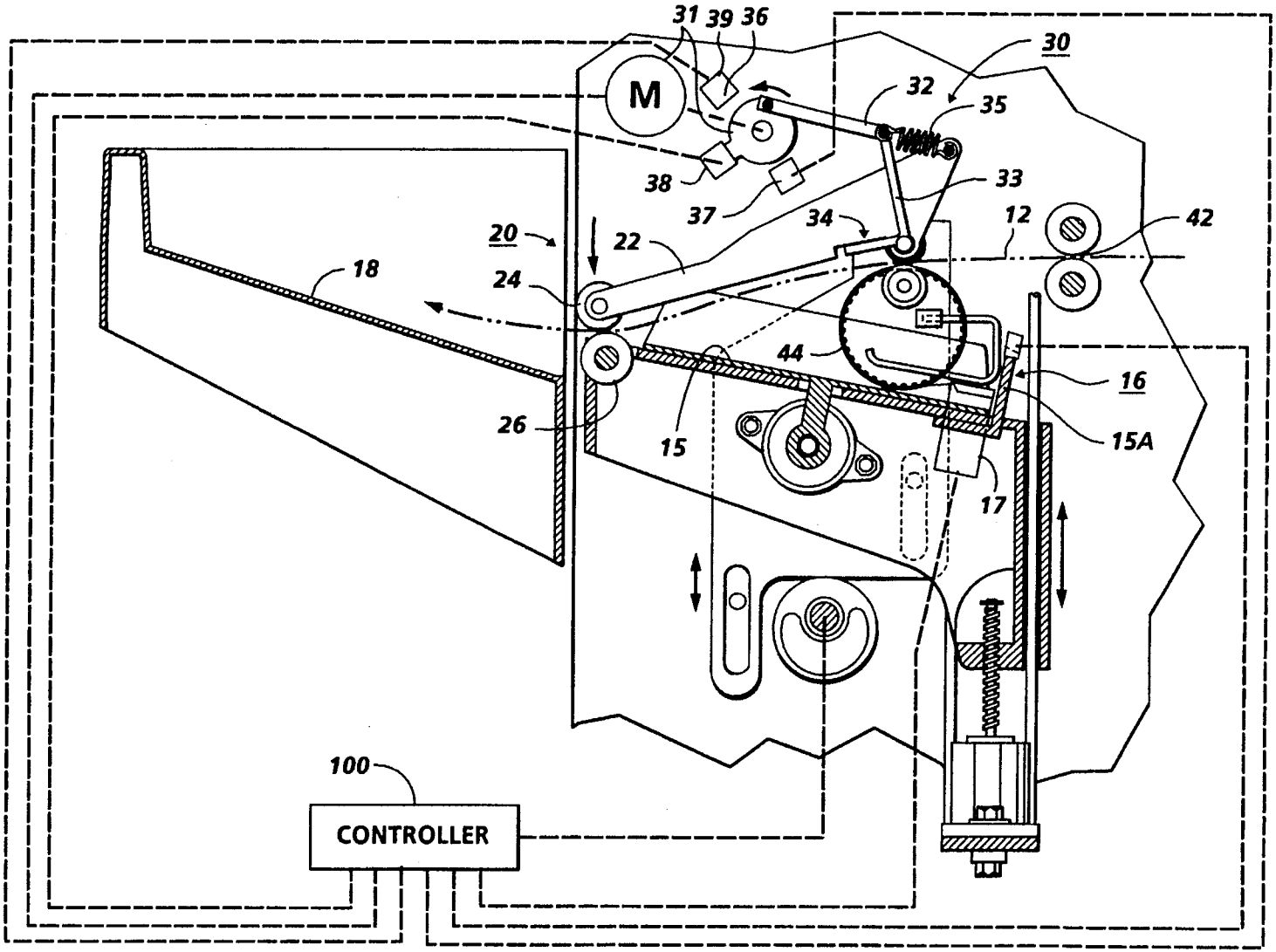
Figure 1C:
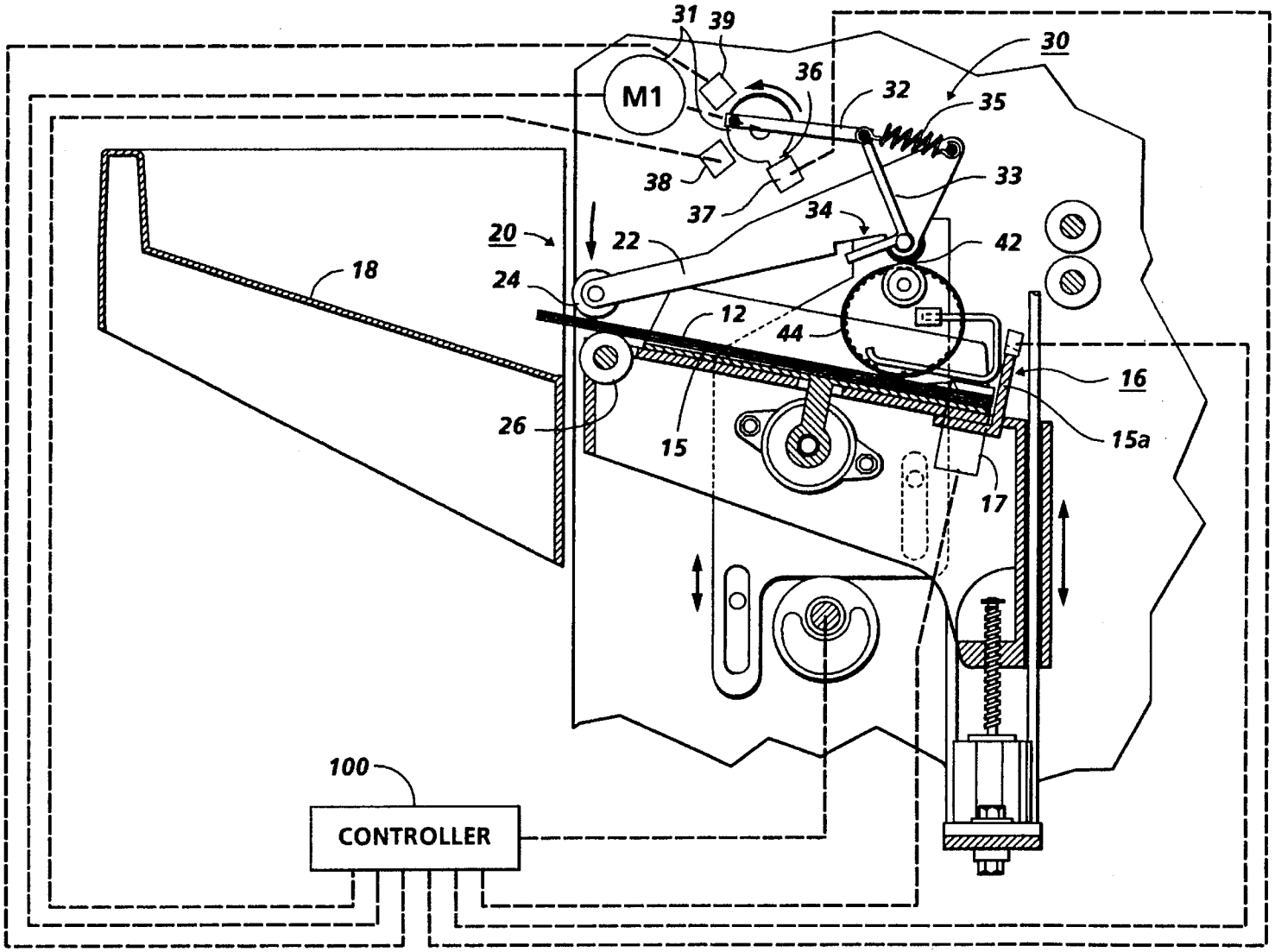

In the other closed nip mode of operation, as in FIG. 1C, a closed nip is provided with a heavy nip or normal force for feeding out a stack of sheets which have been compiled in the compiler tray 15. This greatly increased normal force for heavy set ejection is also provided by the variable normal force system 30, as will be further described below. Typically, such ejected compiled sets in this mode will also have been stapled in the compiler unit 16 by an integral set stapling system 17, and thus are particularly susceptible to disheveling or tearing the top or bottom sheet of the stapled set during ejection if proper normal force is not applied to provide for non-slip feeding of the entire stack set.

In addition to the three operational modes described above, and further described below, an additional desired design criteria is to provide nip force application means having a large amount of overtravel, or to otherwise provide for safety considerations. That is, if something were somehow under the eject arm 22 or eject roller 24 when the system is closing, the closing force should be limited. The closing movement should not, for example, fully deflect a spring and "bottom out" until the motor stalls out with an unacceptably high force. It is also desirable that the eject arm 22 should open or lift for jam clearance as part of the shut down procedure of the system after certain faults, although it does not have to open simply when power is removed. The cited references teach jam detectors which can be conventionally connected to motor M1 via controller 100 here.

To summarize said three modes of operation there are at least three different desired eject nip pinch forces to be provided, all with low power consumption, for varying print media feeding requirements, by the variable force system 30. One is zero pinch force with an open nip to allow sheets to reverse between the exit pinch rolls 24, 26 for registration in the compiler. Another is a low pinch force to avoid marking carbonless sheets or other delicate individual sheet alternatively being fed by the same nip. Another is a high nip force to maintain stack integrity during stack ejection, by high paper-to-paper or intersheet friction when ejecting a stacked set. This high force on the nip during thick set ejection is needed to ensure that a complete set can be driven out without shingling or tearing the outermost sheets, as noted.

Referring further to details of the embodiment of FIG. 1, it may be seen that this system 30 requires less power by requiring the motor M1 to only work against spring force 35 only in the closed nip position for stack ejection, rather than during the entire nip opening or closing operation. This is a significant improvement over prior systems, such as that shown in FIG. 2, in which the eject arm is spring loaded into the closed position and is opened by a motor driven cam always working against that spring force to open the eject nip. Such prior art systems also have excessive nip normal force for individual sheets or small sets. Furthermore, this nip force in the present system is self-adjusting based on the stack thickness, i.e., increasing automatically with the increase in thickness of the set to be ejected form the compiler. The high nip force is generated here only in the primary or set ejection mode. The spring 35 load is applied here only after the eject nip 24, 26 has been fully closed onto the sheets between rolls 24 and 26 by full downward movement of the sheet ejector arm unit 22. This drastically reduces the drive torque and power required to operate the system. The system here also optionally allows the final applied nip force to be varied by stopping the drive system in two or more different positions.

As the motor M1 rotates the nip opening and closing drive system 31, here this reciprocally moves the crank arm or drive linkage 32, which is in turn oscillates the pivot arm or camming lever 33 here. The illustrated right angle extension of the pivoted camming lever 33 here is adapted to intermittently engage a cam engagement or lifting surface 34 on the sheet ejector arm unit 22.

As shown, one end of spring 35 is connected to the end of the set ejector arm unit 22 opposite the pinch roll 24. The other end of spring 35 is connected to, and moves with, camming lever 33. The spring 35 can partially pull the ejection arm 22 towards the camming lever or pivot arm 33, but the spring 35 only deflects to generate counter nip force only after the nip has been fully closed, as will be described.

As the nip opening and closing drive system 31 rotates, its position may be detected by suitable means, such as the illustrated extending rotating flag 36 successively actuating rotation sensors 37, 38 and 39. Note that a single sensor plus a simple timing algorithm could be used in place of the three sensors 37, 38 and 39 illustrated here. Alternatively, a single sensor and a signal from an "arm closed" interlock switch, as in FIG. 4, may be used. Or, two separate flags may be used with two sensors, to provide four states of position detection from the respective switch activations or non-activations, i.e., 00, 01, 10 and 11.

As shown in the respective illustrated positions of FIG. 1, in FIG. 1A the ejection arm 22 is just starting to close. The opening and closing drive system 31 is not working against any spring load from the spring system 35. In FIG. 1B, the ejection arm 22 has closed to close the nip 24, 26, and drive system 31 has been stopped with the flag 36 blocking the first sensor 38. A low nip force is generated in this drive system 31 position in the nip between rollers 24 and 26. This is the position for feeding delicate single sheets through the system. Note that in this position the cam engagement surface 34 is not contacted by the camming lever 33 and only the spring 35 is acting to provide normal force (in addition to gravity) to the nip 24, 26. That is, the cam engagement surface 34 is fully disengaged from the camming lever 33 in this position.

Referring to the next Figure, 1C, the drive system 31 is driven further or not stopped until flag 36 reaches the second sensor 37 position. In this position and mode, the variable normal force system 30 has increased the normal force substantially, for set ejection, because the drive linkage 32 has now been rotated further to further rotate the camming lever 33 and to also pull the end of the spring 35 connected thereto to thereby substantially increase the spring force applied to the ejector arm unit 22 by tensioning spring 35. The machine controller 100 knows whether set compilation or single sheet outputting has been selected and controls the drive system 31 to stop at the corresponding desired sensor position.

Figure 1D:
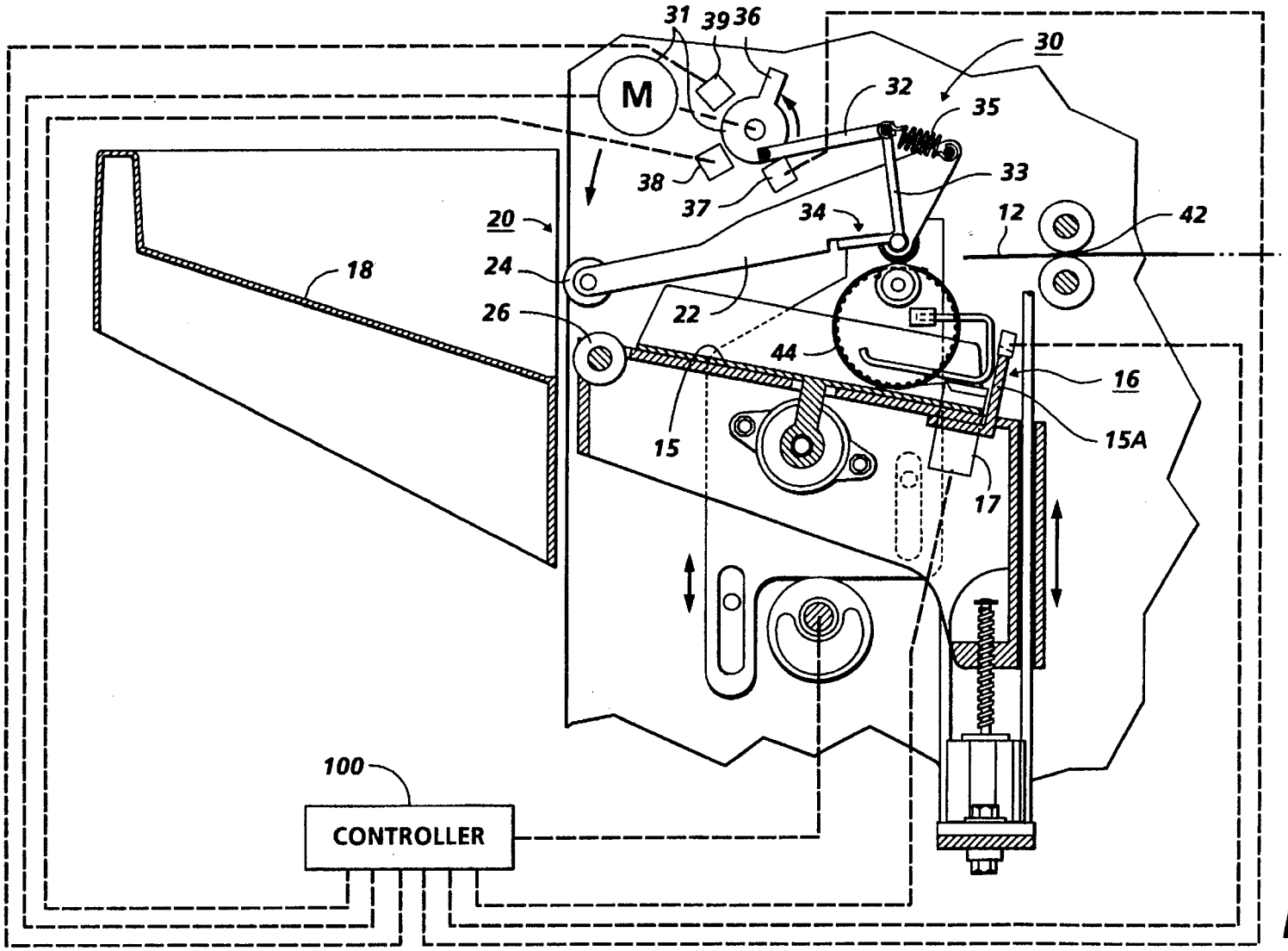

In the next step, illustrated in FIG. 1D, there is illustrated the lifting or opening of the ejector arm unit 22 by further rotation of the nip opening and closing drive system 31, which now oscillates the camming lever 33 in the opposite direction so that the cam engagement surface 34 is now engaged and lifted by this movement of the camming lever 33. This position can be signaled by a sensor 39. Note that in this position the drive system 31 is not working against any spring load from the spring force system 35 because the cam engagement surface is now resisting the load from the spring (which is still in tension) and the camming lever 33 and the ejection arm 22 act as a single freely pivoting solid body.

Referring further now to the FIG. 4 embodiment, here after a set has been compiled and stapled, it is ejected using a similar eject roller nip 70 (in its closed or phantom line position). The nip 70 is closed using a DC motor 71 driving a linkage 72 attached to the eject arm 73 as shown. The mechanism that opens and closes the eject arm 73 can be stopped in the upper (or open) (solid line) position, or in one of two closed positions, as in the other embodiments. The signal from a home sensor 76 here is used in conjunction with a signal from an interlock switch 78 to stop the eject arm 73 in the correct location. (See the table below for further details.) When the eject arm 73 is in the first closed position, the nip 70 is loaded with a low nip force of approximately 4.0 N. This position is used to transport single sheets in non-stapling modes. In the second closed position, nip 70 is loaded with a high nip force of approximately 7.0 N. This higher force is sufficient to eject stapled sets without slip at the sheet-to-sheet interfaces.

The upper rolls 80 of nip 70 are elastomer drive rolls and the lower rolls 82 are idlers. The idler rolls 82 may be shaped to provide corrugation to the sheets or sets passing through the nip. If the 70 nip is driven by the same motor (not shown here) as the upstream or feed-in drive nip (not shown here) that upstream nip may be released during set ejection so that the lead edge of the next incoming sheet can enter without velocity mismatch problems. The set ejection arm is preferably always left in the closed position between jobs to provide a physical barrier preventing operators from inserting their fingers into the compiler area during movement of the finishing carriage. The interlock switch 78 prevents the stapler motor and the carriage vertical drive motor from operating when the eject arm 73 is open. At the start of each job, the eject arm is initialized to the low force closed position. This initialization procedure is accomplished by running the eject arm motor 71 until sensor 78 is blocked while interlock switch 78 is in the open state, as in the Table.

TABLE

EJECT ARM POSITIONING

[To stop the eject arm 73 in desired position, drive motor 71 until sensor 76 transition occurs with switch 78 at state listed, wait specified time delay and stop motor 71 using DC braking]

| DESIRED STOP POSITION | Sensor 76 TRANSITION | Interlock Switch 78 STATE |
|---|---|---|
| Open | Blocked | Not Actuated (contacts closed) |
| Closed (low force) | Blocked | Actuated (contacts open) |
| Closed (high force) | Unblocked | Actuated (contacts open) |

It will be appreciated that there are a number of other possible alternative mechanisms to achieve the functions described herein. For example, the crank arm 32 could be replaced by a pin in an eccentric cam track or an eccentrically mounted cam on a motor shaft inside a yoke which is U-shaped, C-shaped, or elongated. The cam can engage one side of the yoke to lift up the arm in one rotary position, but then in intermediate positions of the eccentric cam rotation not engage the yoke, and thus allow the arm to drop so that the weight of the arm holding the ejector rollers would provide the light, normal force of the second mode for single delicate sheets. This could be assisted with a partial counterbalanced spring. Then, further rotation of the eccentric cam could engage the other side of the oversized yoke to press down the arm with the desired higher normal force, preferably indirectly through a spring.

While the embodiments disclosed herein are preferred, it will be appreciated from this teaching that various alternatives, modifications, variations or improvements therein may be made by those skilled in the art, which are intended to be encompassed by the following claims:

What is claimed is:

1. In an output sheet handling system for a reproduction apparatus, for selective stacking of the output sheets into at least one stacking tray, with a sheet ejection system for gripping and ejection of the output of the printed sheets from said reproduction apparatus into said stacking tray sequentially as individual output sheets or as a compiled stack of plural output sheets, the improvement wherein said sheet ejection system includes an automatic variable normal force system automatically providing a substantially higher gripping normal force for said ejection of said compiled stack of plural output sheets than for said ejection of said individual output sheets.

2. The output sheet handling system of claim 1, wherein said output sheet handling system includes a compiled sheets set stapling system, and wherein said sheet ejection system provides ejection of the output of printed sheets as a compiled and stapled stack of plural said output sheets from said reproduction apparatus, ejected by said sheet ejection system into said stacking tray as a stapled set of plural output sheets.

3. The output sheet handling system of claim 2, wherein said sheet ejection system increases said gripping normal force for said ejection in proportion to the thickness of said compiled stack of plural output sheets being ejected.

4. The output sheet handling system of claim 1, wherein said sheet ejection system comprises a closable sheet feeding nip providing said gripping normal force and said ejection and with at least two different operating modes; a first closed nip mode for said ejection of the output of printed sheets into said stacking tray as a previously compiled stack of plural said output sheets through said nip with said substantially higher gripping normal force in said nip, and a second closed nip mode for feeding individual delicate sheets through said nip with an automatically substantially lower said gripping normal force in said nip than in said first mode.

5. The output sheet handling system of claim 4, wherein said output sheet handling system includes a compiled sheets set stapling system, and wherein in said first mode said sheet ejection system provides ejection of the output of printed sheets as a compiled and stapled stack of plural said output sheets from said reproduction apparatus, ejected by said sheet ejection system into said stacking tray as a stapled set of plural output sheets.

6. The output sheet handling system of claim 4, in which said gripping normal force of said nip has a maximum force limit set to protect an object improperly inserted therein.

7. The output sheet handling system of claim 4, further including a third operating mode of said sheet ejection system in which said closable sheet feeding nip is open, with no sheet gripping normal force, to provide unobstructed sheet compiling prior to said sheet stack ejection with the sheets being compiled partially extending through said open nip.

8. The output sheet handling system of claim 7, further including a fourth operating mode of said sheet ejection system in which said closable sheet feeding nip is opened automatically in response to a sheet jam signal for sheet jam clearance.

9. The output sheet handling system of claim 4, wherein said sheet ejection system includes a nip opening and closing drive system for said closable sheet feeding nip, and an associated spring force system actuated to provide said substantially higher gripping normal force in said nip in said first mode in response to said drive system continuing to operate after closing said sheet feeding nip.

* * * * *

UNITED STATES PATENT AND TRADEMARK OFFICE

CERTIFICATE OF CORRECTION

PATENT NO. : 5,462,265

DATED : October 31, 1995

INVENTOR(S) : S. Resto

It is certified that error appears in the above-indentified patent and that said Letters Patent is hereby corrected as shown below:

On the Title page, item [75], Inventors Name, "Suzzette S. Resto" should read --Suzzette Solano Resto--.

Signed and Sealed this

Fourteenth Day of May, 1996

*Attest:*

Bruce Lehman

BRUCE LEHMAN

*Attesting Officer*

*Commissioner of Patents and Trademarks*